US012196534B1

(12) United States Patent
Unger

(10) Patent No.: US 12,196,534 B1
(45) Date of Patent: Jan. 14, 2025

(54) EXPANDING SHOTGUN SLUG WITH METAL GUIDANCE FLAPS

(71) Applicant: Sebastian Josef Unger, Wolfsgraben (AT)

(72) Inventor: Sebastian Josef Unger, Wolfsgraben (AT)

( * ) Notice: Subject to any disclaimer, the term of this patent is extended or adjusted under 35 U.S.C. 154(b) by 0 days.

(21) Appl. No.: 18/380,517

(22) Filed: Oct. 16, 2023

(51) Int. Cl.
*F42B 12/34* (2006.01)
*F42B 7/10* (2006.01)

(52) U.S. Cl.
CPC ..... *F42B 12/34* (2013.01); *F42B 7/10* (2013.01)

(58) Field of Classification Search
CPC .... F42B 7/10; F42B 12/34; F42B 7/02; F42B 7/00
USPC ..... 102/507–510, 448, 449, 439, 503
See application file for complete search history.

(56) References Cited

U.S. PATENT DOCUMENTS 2,290,851 A * 7/1942 Addicks ..... F42B 7/10 299/20
10,443,990 B2 * 10/2019 Yadon ..... F42B 12/367

FOREIGN PATENT DOCUMENTS

FR 2846410 A1 * 4/2004 ..... F42B 12/04
WO WO-2014077793 A1 * 5/2014 ..... F42B 12/78

OTHER PUBLICATIONS

Brand: D Dupleks Product: Hexolit 32 Homepage: <<https://www.ddupleks.com>>.
Brand: D Dupleks Product: Hexolit 32 photo: <<https://www.shootingstore.at/1413-large_default/ddupleks-1276-hexolit-32-5-stk-packung.jpg>>.
Brand: American Reserve Munitions Product: 12 Gauge 435gr.—"The Gatekeeper" Homepage: <<https://gatekeeperammo.com/>>.
Brand: American Reserve Munitions Product: 12 Gauge 435gr.—"The Gatekeeper" photo: <<https://www.snipershide.com/shooting/threads/strange-12-gauge-ammo.7020995/>>.
Brand: Operators American Tactical Hardware Product: 12gauge TSR (Tango Shotgun Round) Aluminum Homepage: <<https://www.oathammo.com/>>.
Brand: Operators American Tactical Hardware Product: 12gauge TSR (Tango Shotgun Round) Aluminum photo:<<https://scducks.com/forum/showthread.php?198391-12-gauge-Boom>>.

* cited by examiner

*Primary Examiner* — Reginald S Tillman, Jr.
(74) *Attorney, Agent, or Firm* — Ronald J. Koch

(57) ABSTRACT

Improved shotgun ammunition providing improved guidance for a large range of different barrel diameters without the use of plastic wads that separate the metal of the projectile from the barrel, while decreasing the stress for the barrel material, providing the greatest possible expansion of the projectile during impact on soft targets.

1 Claim, 9 Drawing Sheets

Silver Dollar

EXPANDING SHOTGUN SLUG WITH METAL GUIDANCE FLAPS

FIELD

This invention relates generally to firearms, and more particularly to shotgun slug ammunition, which usually consists of a large projectile instead of smaller pellets, such as birdshot or buckshot.

BACKGROUND AND SUMMARY

One typically uses a slug instead of a group of smaller projectiles (e.g. pellets, such as birdshot or buckshot) to direct the impact to a single location, thus avoiding the spread of the smaller projectiles that increases as they travel from the muzzle. Slugs are mainly used at relatively short distances (e.g. up to 100 yards), in most cases below 50 yards. Slugs are impractical for longer distances for various reasons. Their large front surface causes a fast decrease of speed, due to various factors such as wind resistance, and ballistic coefficient. Additionally, slugs are less stable because they are discharged from a non-rifled barrel.

The relatively larger mass of a slug makes it better suited to transfer a relatively larger amount of force. Muzzle energy is greatly related to the stopping power of a firearm, therefore shotgun slugs are very often a preferred choice when high stopping power at short distances is required.

A disadvantage of a conventional one-piece slug (e.g. lead), compared to multi-piece designs, is that the amount of overpenetration is significant. For instance, a penetration of 20-30 inches or more in ballistic gelatine can be reached with 12 gauge slugs with high power loads, increasing the risk of undesired consequences (e.g. collateral damage). Various solutions have been proposed to address these issues.

For example, deforming slugs increase the amount of surface area when hitting the target, which reduces penetration depth. Deforming slugs typically use plastic wads that completely cover the slug to adapt to a range of barrel diameters. Additionally, rubber rings, similar to o-rings, are utilized to give the slug the needed guidance and adaptability to different barrel diameters. Some projectiles stick out of the wad, which makes them smaller than the barrel diameter because of the lack of adaptability to the barrel diameter.

Using plastic wads or rubber rings greatly reduce the diameter of the slug as well as the diameter of the expanded slug per length, causing a significant decrease of the surface area when hitting the target. The decrease of weight per length of the projectile compared to the subject technology causes disadvantages for the weight distribution. It is therefore desirable to eliminate the need for wads and o-rings in the front section.

Conventional systems do not adequately address the foregoing problems, and moreover do not address the other problems of conventional systems, as will be apparent to the skilled person.

"DDupleks Hexolit 32" (trademark) (FIGS. 7A, 7B) has a smaller diameter of the metal projectile, smaller expansion, less weight of the projectile, less reliable expansion, inferior retention of the flaps, no direct contact of the metal projectile to the barrel, and require additional plastic rings for guidance. The plastic rings result in less surface area utilized.

"Gatekeeper" (trademark) (FIG. 8) incorporates a classic wad design, and does not expand to the barrel inner surface. It offers guidance only over a short length of the bullet, no guidance in the front area, metal projectile not touching the barrel, less weight, less power, less expansion with about 40 mm, more expensive production, because of the narrow cuts that are apparently EDM wire cut. The "EBR expander" (trademark) is very similar to the gatekeeper but has even greater decreased expansion, and the metal slug is completely covered in a plastic wad.

"Oath 12ga TSR" (trademark) slug (FIG. 9) is a one-piece metal construction that requires o-rings. It is inferior to the subject technology in that the bullet is necessarily heavier, and has less muzzle energy. The volume of the projectile is unnecessarily high, and the design under-penetrates, and has bad retention of the flaps. Production costs of this product appear to be relatively higher.

Common shotgun barrels are smooth-bore (i.e. not rifled), so the center of mass of the projectile has to be as far forward as possible to stabilize the flight path of the projectile. Consequently, weight distribution that is not frontally maximized negatively affects the stability of the flying path and precision of the projectile.

Existing technologies suffer from the foregoing problems, and are thus inferior to the subject technology presented herein. The subject technology incorporates metal flaps arranged circumferentially as part of a front metal portion connected to a back plastic portion. The gap between the flaps has been increased, and spring tension is utilized such that the flaps contact the barrel during firing. Additionally, the wider gap results in lowered production costs.

The flaps form an outer diameter that is larger than the inner diameter of the gun barrel. Thus, the flaps are urged against the barrel and act similar to leaf springs, which push outwardly on the inside of the gun barrel, and expand upon discharge from the muzzle. Thus, surface area is maximized. Decreased production costs are achieved because the need for rubber rings and wads in the front section is eliminated. Additional advantages are achieved by the size of the flaps and the size of the cutouts (i.e. space between each flap). The cuts can be easily made with saw blades on CNC mill/lathe and thus don't require EDM wire cutting. The subject technology also provides a more reliable connection between the parts and decreases the chance of separating of the parts in the barrel or after exiting the barrel.

The improved frontal weight distribution of the subject technology results in a more stable flight path, and the overall weight of the projectile can be adjusted to a variety of needs to a greater degree than current designs, without increasing the length of projectile. The subject technology offers the new possibility of using the whole barrel inner diameter for the projectile. Also, harder metals can be used. Another advantage of the subject technology is the entire length of the projectile is utilized for guidance inside the barrel.

The 2-part, maximized diameter design of the projectile of the subject technology not only allows for a shorter projectile with a better weight distribution, but also allows for greater possibilities of adjusting expansion properties.

The subject technology utilizes a metal first portion, a portion of which is inserted into a second plastic portion. The two-piece projectile is discharged from the muzzle. The first metal portion includes a plurality of flaps, each being circumferentially arranged and spaced apart. Each of the plurality of flaps has an inside surface that is angled upward and radially outwardly, such that each said flap is urged outwardly upon impact in soft targets. This results in a drastic increase in surface area upon impact. In one aspect, the inside surface (aka first angled surface) 14 of the flaps of the subject technology is angled at 45 degrees (see FIG. 1B)

to facilitate expansion of the projectile. The rear parts of the flaps terminate at a rear portion of the metal front portion. The increased gap between each flap of the subject technology allows the flaps to be more easily compressed while in the barrel. The flaps can then flex somewhat to function similar to leaf springs, that push the front of the flaps against the inside of the barrel for heightened precision, while also acting against expansion when hitting the target. Therefore, it is possible to get a wider variety of expansion properties by changing the thickness of the flaps.

The flaps of the subject technology incorporate a sharp leading edge 4 (FIG. 3) that improves the cutting performance of the projectile, especially in hard materials. A significant advantage of the subject technology is thereby achieved in that when the projectile hits the target, the force per surface area is greatly concentrated because of the sharp edge. This results in greatly improved cutting performance in hard materials combined with very reliable expansion of the flaps when impacting in soft targets.

An optional plastic insert is placed into a cavity in the first metal portion, radially inside of the flaps. This insert can be used to vary the degree to which the flaps are allowed to be urged inwardly. This feature can be used to adjust to different barrel diameters. This allows resistance for compression to be varied independently from the resistance against the expansion of the bullet, and it also gives the projectile more stability. It also adds stability for the projectile during the loading procedure in semiautomatic firearms, to avoid undesired deformations.

With the subject technology it is possible to use a much heavier projectile at much higher velocities with full weight retention compared to conventional designs. There is no other design that expands to such diameters with comparable powerful loads with similar reliable retention of the flaps.

The guidance of the projectile is also improved because the flaps are always touching the barrel, so the projectile is guided over its complete length with a very similar resistance, which is not possible with current designs. After leaving the barrel, the projectile expands because of the flaps acting as leaf springs in their elastic range in larger barrel diameters, which is also not possible with plastic wads or plastic rings, neither of which are needed by the subject technology.

An optional rear cavity 17 (FIG. 1B) can be used as space for gun powder, making it possible to increase the length of the projectile while reducing the overall length of the cartridge, leading to a longer, more stable flying projectile in a shorter cartridge that can be used in shorter chambers, which increases the overall number of chamber dimensions the cartridge can be used in.

The improvements made by the subject technology have resulted in surprisingly good and unexpected test results. The projectile penetrated hard targets like sheet metal without any expansion and therefore a reduced loss of energy, while reliably expanding in soft materials with good retention of the flaps retaining its full weight most of the time.

REFERENCE NUMERALS IN DRAWINGS

Figure 1B:
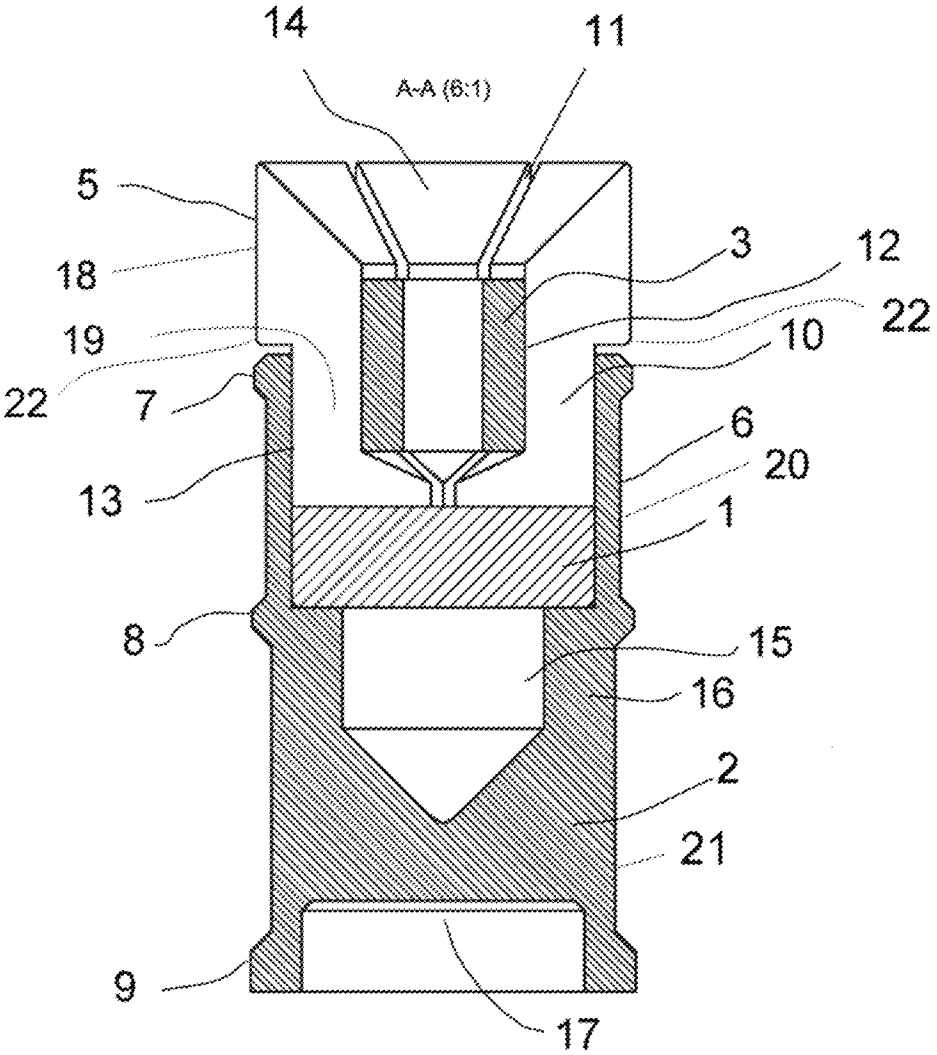
FIG. 1B depicts a cross-sectional view of the subject technology in one aspect.
Figure 1A:
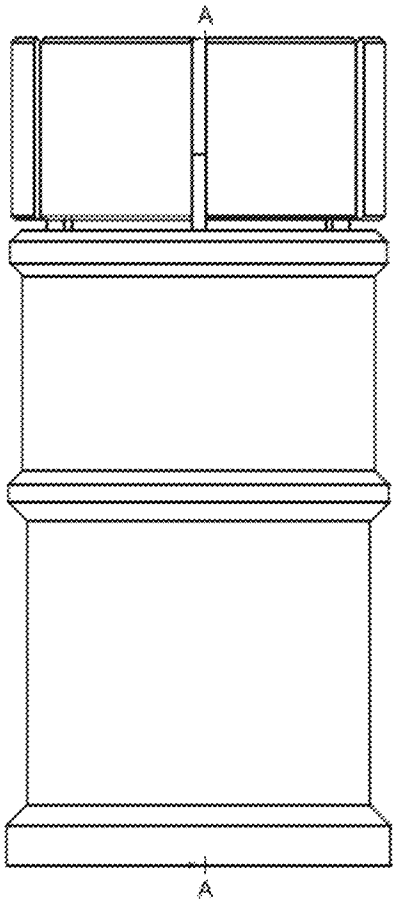
FIG. 1A depicts a front view of the subject technology in one aspect.

The table below lists the reference numerals employed in the figures, and identifies the element designated by each numeral.

1 first portion 1 (metal in one aspect) (aka metal projectile)
2 second portion 2 (plastic in one aspect) (aka plastic rear part)
3 third portion 3 (plastic in one aspect) (aka second plastic part)
4 edge 4 of first portion 1
5 outer diameter 5 of first portion 1 (flaps 10)
6 neck 6 of second portion 2
7 first gas seal surface 7 of second portion 2
8 second gas seal surface 8 of second portion 2
9 third gas seal surface 9 of second portion 2
10 flaps 10 of first portion 1
11 cutouts 11 of first portion 1
12 bore 12 of first portion 1 (aka interior cavity)
13 outer diameter 13 of rear portion 19 of first portion 1
14 first angled surface 14 of first portion (flaps)
15 first cavity 15 of second portion 2
16 side walls 16 of second portion 2
17 second cavity 17 of second portion 2
18 front portion 18 of first portion 1
19 rear portion 19 of first portion 1
20 front portion 20 of second portion 2
21 rear portion 21 of second portion 2
22 shoulder 22 of first portion 1
23 second angled surface 23 of first portion 1

DETAILED DESCRIPTION

In one aspect, a shotgun projectile comprises first and second portions 1, 2 respectively, that are combined and fired from a shotgun. In one aspect, the parts 1 and 2 are combined by friction fit. Adhesive can be also used.

In one aspect, the first portion 1 is made from metal and has front 18 and rear 19 portions. Second portion 2 is made from plastic and has front 20 and rear 21 portions. The front portion 20 of the second portion 2 is adapted to receive the rear portion 19 of the first portion 1 therein such that a shoulder 22 of the first portion 1 abuts the front portion 20 of the second portion 2. As shown for example in FIG. 1B, rear portion 19 of first portion 1 fits within a bore in neck 6 of second portion 2. It should be noted that as shown in FIG.

1B, the shoulder 22 is not in direct contact with the front portion 20 of the second portion 2, but in another aspect there is direct contact.

The first portion 1 has an interior cavity (aka "bore") 12, and a plurality of flaps 10, each said flap being circumferentially arranged around the interior cavity 12. Each of the plurality of flaps is spaced apart, and terminates at the rear portion 19 of the first portion 1. Each flap has a proximal end with a surface 14 that is angled upwardly, and a distal end that terminates, or is connected to, the second end 19 of the first portion 1. In one aspect, the first portion 1 is machined from a single piece of metal, such that the flaps are flexible and can be compressed inwardly.

Figure 3:
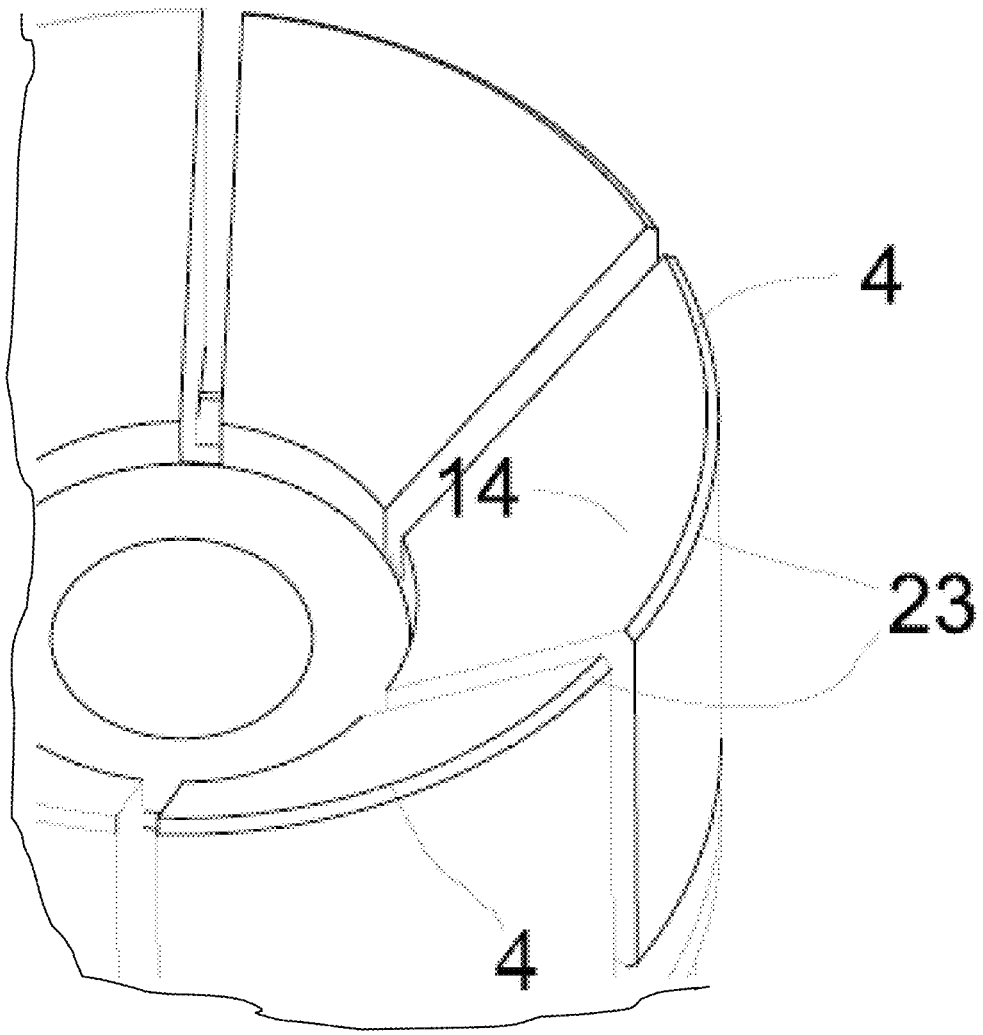
FIG. 3 depicts a fragmentary perspective view of the subject technology in one aspect.

The plurality of flaps 10 form an outer diameter 5 of the front portion 1. Each of the plurality of flaps 10 has an edge 4 formed from first and second angled surfaces 14, 23. As shown, for example in FIG. 3, first angled surface 14 is angled upward and radially outwardly (relative to interior cavity 12), and second angled surface 23 is angled relative to first angled surface 14 to form an edge 4. The sharpness of this edge can be varied to achieve different impact profiles. The outwardly angled surface 14 facilitates outward expansion of flaps 10 upon impact. Surprisingly good and unexpected results where discovered by increasing the surface area of surface 14 relative to existing technologies, thereby achieving yet another advantage.

Figure 4:
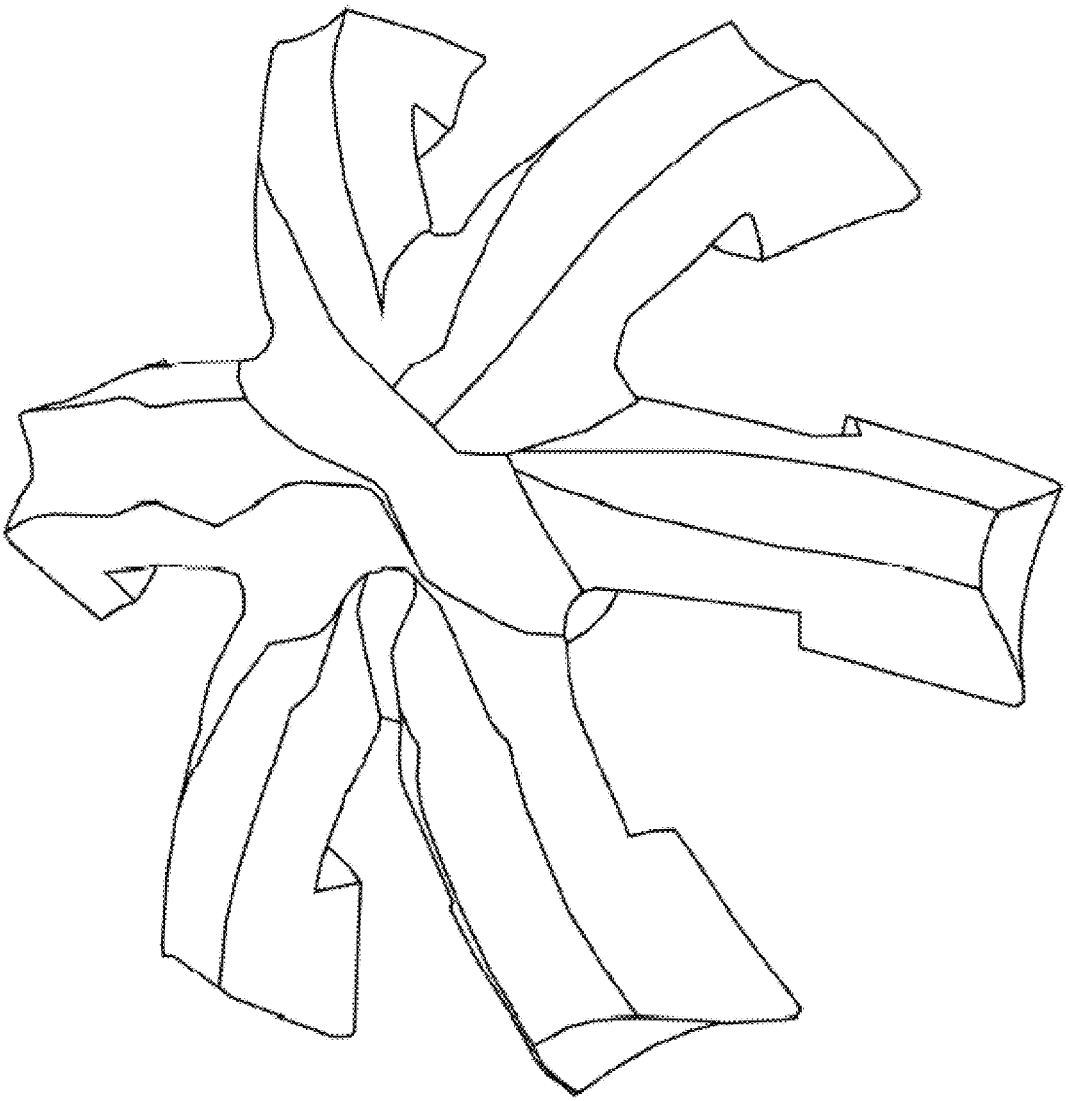
FIG. 4 depicts front portion 1 post-impact, of the subject technology in one aspect.

The first angled surface 14 of each of the plurality of flaps 10 is angled upward and radially outwardly, whereby each said flap is urged outwardly upon impact, and this causes the first portion to be detached from the second portion as the flaps expand outwardly. FIG. 4 depicts the front portion in one aspect after impact, the flaps having expanded outwardly. This expansion can be adjusted by varying the thickness of the flaps, the metal used, and the surface area of the surface 14 of the flaps. As shown in FIG. 4, each of the flaps are urged outwardly. In one aspect, the angle of surface 14 is 45 degrees.

The second portion 2 has a plurality of gas seal surfaces 7,8,9. In one aspect, each said gas seal surface has an outer diameter commensurate with the outer diameter 5 of the first portion 1. In another aspect, gas seal surface 9 has a larger o.d.

The outer diameter 5 of the first portion 1 and the plurality of gas seal surfaces 7,8,9, is adapted to be larger than the inner diameter of a gun barrel through which the first and second portions are discharged. In one aspect, the first and second portions are connected together and inserted inside of a shell case.

In one aspect, the plastic part 2 is relatively lighter than the metal part 1 to focus the center of gravity to the front area. This ensures proper guidance of the projectile. An optional second plastic part 3 (FIG. 2) can be added to increase stability against compression of the metal part 1 and improve/increase the weight distribution to the front area.

During trials, the length, width and thickness of the flaps were refined to ensure reliable expansion as well as good retention when hitting soft targets. The shown design was developed and tested for 12 gauge barrels. For 16-gauge barrels or smaller, part 3 may not be necessary.

The trials have shown that surprisingly good and unexpected results were obtained using annealed copper for projectile 1 because of the large amount of elongation before break and the relatively high density. Other copper-based alloys may also be used. The projectile can be made by different production processes such as CNC machining, casting, forging etc.

For the plastic parts 2 and 3, materials like TPU or PE with a shore hardness in the range of A95 or below worked very well. Softer materials may also be used. Harder plastics such as ASA or ABS don't have the necessary amount of flexibility and broke during the trials.

FIG. 1B depicts a cross-sectional view of the subject technology. In one aspect, part 3 may be slightly oversized in relation to the bore 12 in part 1, while the outer diameter 13 of part 1 is oversized in relation to the bore in neck 6 of part 2, making it possible to assemble the parts without any adhesive or mechanical connection. This aspect achieves several advantages.

In a long shotgun barrel having large volume per length, the gas pressure drops fast and is relatively low in the moment when the projectile leaves the barrel. Many shotgun barrels feature a choke at the end of the barrel, which decreases the barrel diameter at the muzzle end, to reduce the spread of the multiple projectiles (e.g. buckshot). It is an important requirement for the subject technology to function properly with chokes, because the average user cannot be expected to remove the choke before shooting with slugs.

Figure 2:
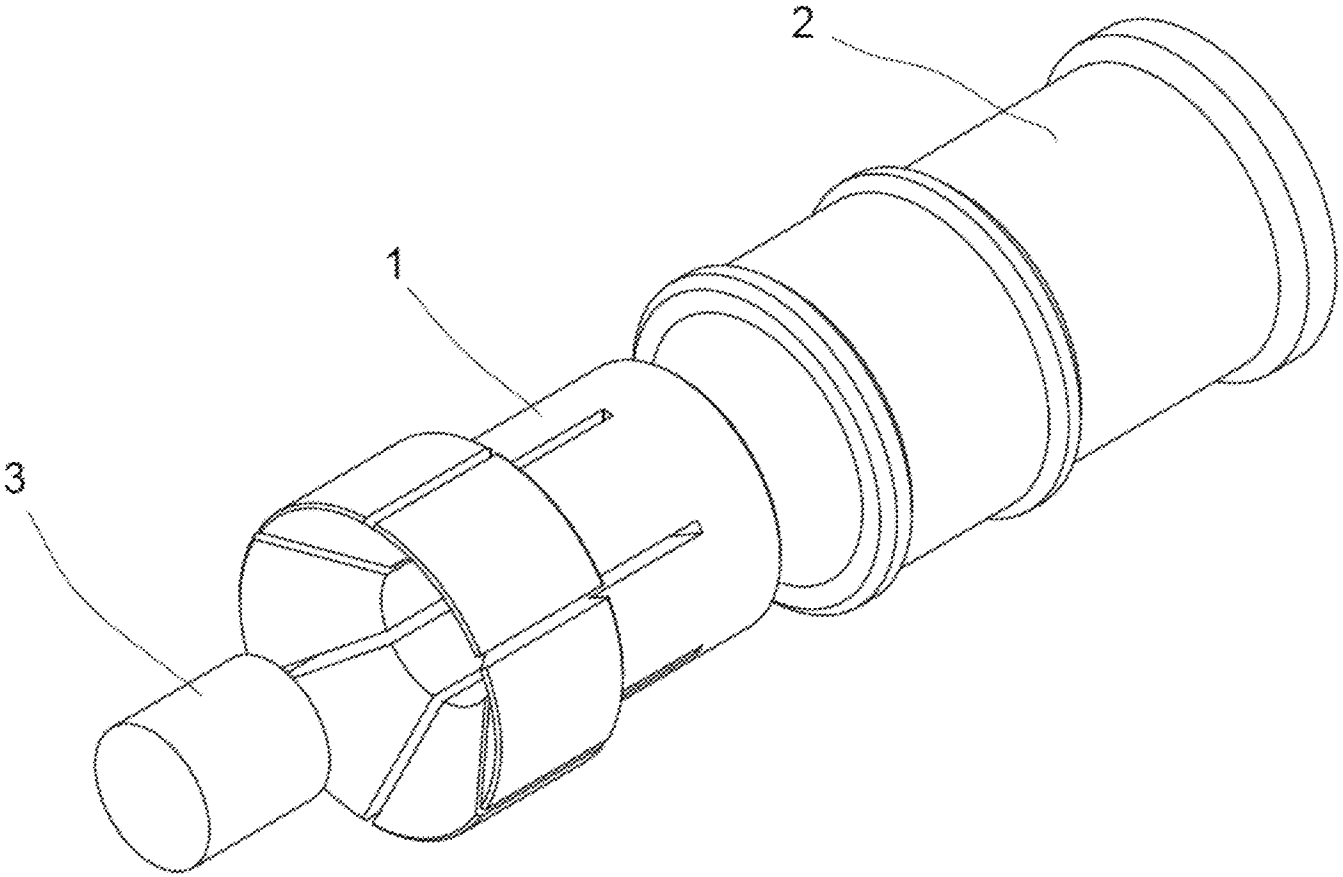
FIG. 2 depicts a perspective exploded view of the subject technology in one aspect.
Figure 5A:
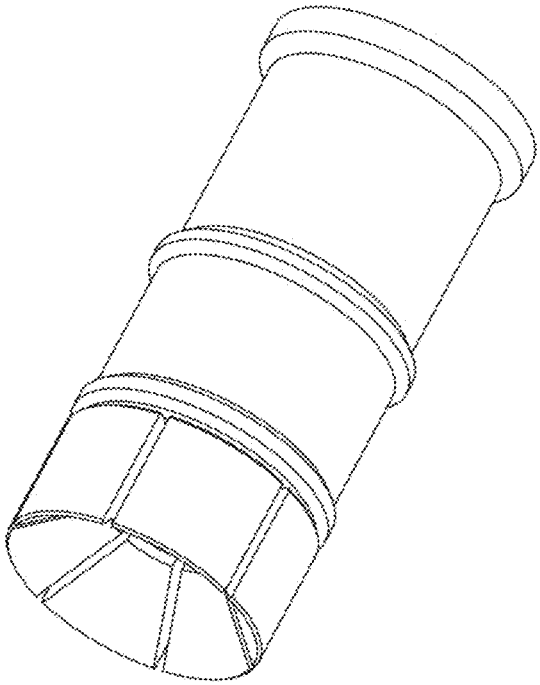
FIG. 5A depicts a perspective view of the subject technology in one aspect.
Figure 5B:
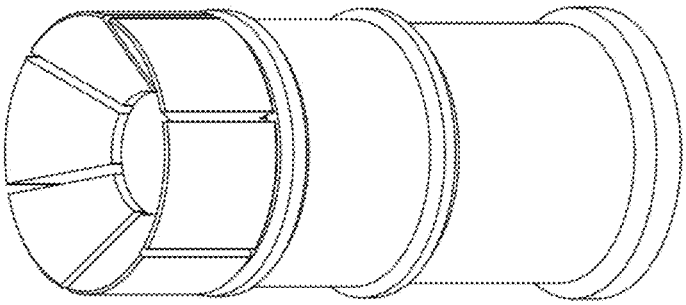
FIG. 5B depicts a perspective view of the subject technology in one aspect.

FIGS. 2, 5A, and 5B show the parts 1, 2, and 3 are cylindrical in nature, and this would be apparent to the skilled person considering that the subject technology is intended to replace conventional shotgun slugs. Early prototypes, that featured a shorter and thinner neck 6 had a separation of part 1 and 2 directly when leaving the barrel. Because of part 2 having less weight and momentum than part 1, both parts got separated when fired trough barrels with a 18 mm choke, the choke slightly reduced the velocity of part 2. So the projectile providing great precision from a 18.60 mm barrel separated when fired from a 18 mm choke and lost its complete function and stability. Consequently, the surface 5 as well as the gas seal surfaces 7, 8 and 9 where then oversized in relation to the barrel diameter, so those surfaces have to compress in diameter which causes friction with the barrel.

Figure 6B:
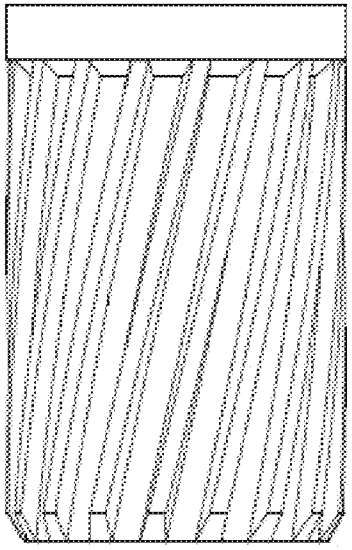
FIG. 6B depicts a perspective view of second portion 2 of the subject technology in one aspect.
Figure 6A:
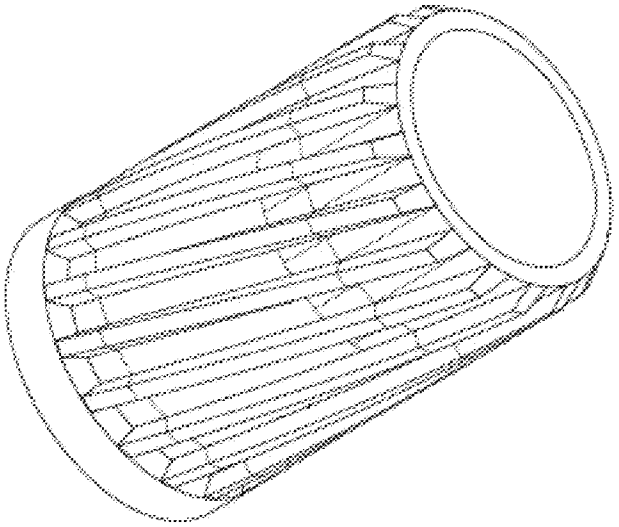
FIG. 6A depicts a perspective view of second portion 2 of the subject technology in one aspect.
Figure 7A:
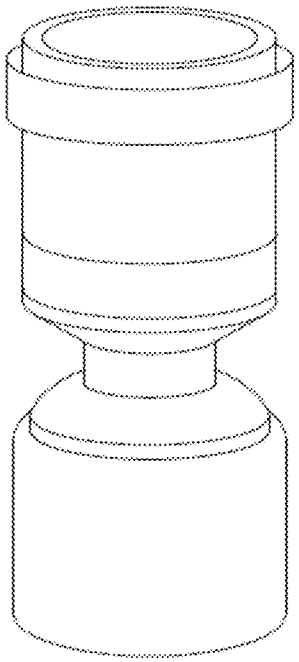
FIG. 7A depicts photos of conventional systems that do not form part of the invention.
Figure 7B:
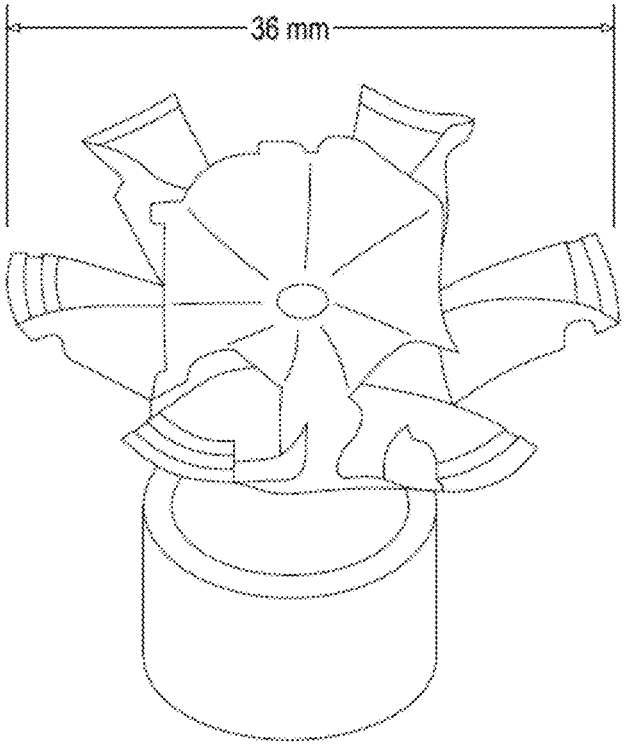
FIG. 7B depicts photos of conventional systems that do not form part of the invention.
Figure 8:
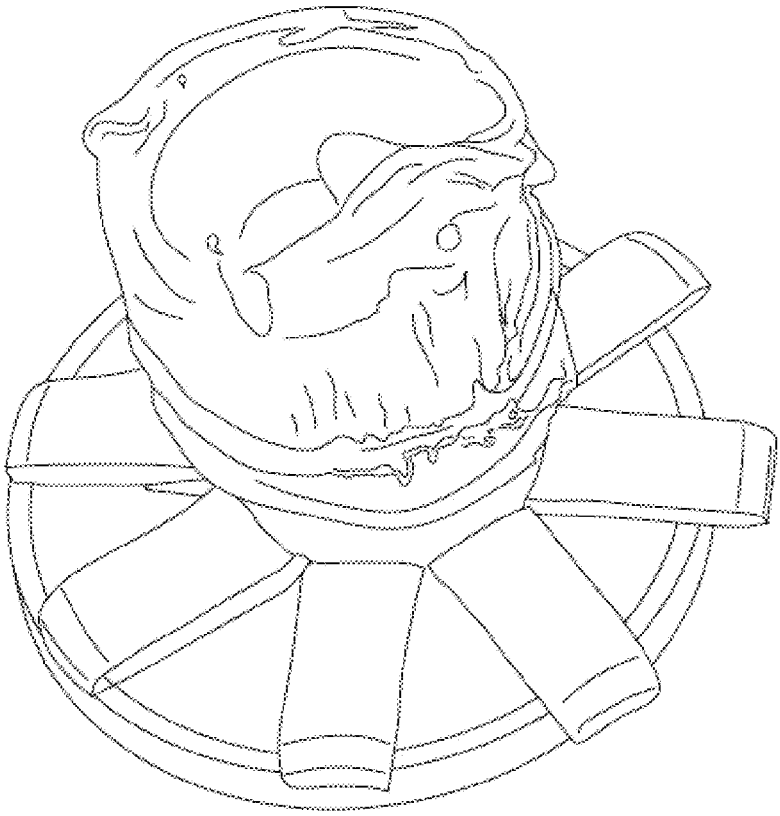
FIG. 8 depicts photos of conventional systems that do not form part of the invention.
Figure 9:
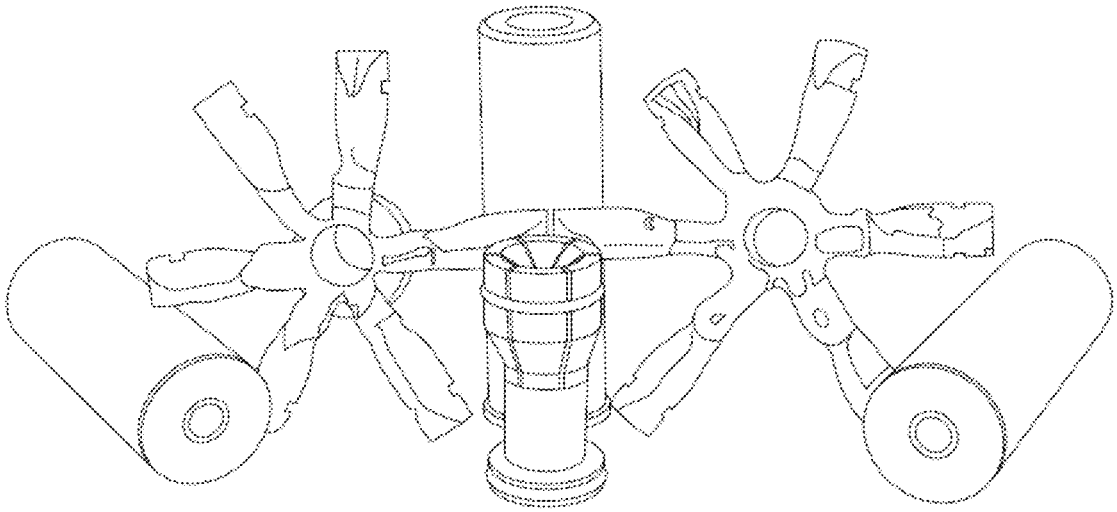
FIG. 9 depicts photos of conventional systems that do not form part of the invention.

In one aspect, a completely different design for part 2 is shown in FIGS. 6A, 6B. The part in one aspect is made from similar plastics and features only one gas seal, and features a rifling that has an slightly oversized diameter compared to the inner diameter of the barrel, causing the projectile to twist and stabilize at shorter overall lengths.

When the projectile starts leaving the chamber, because of the ignition of the powder and pressure building up, the projectile gets pushed into the barrel, the oversized outer diameter 5 of the projectile 1 makes contact with the barrel and is thereby able to adjust to a wide range of barrel diameters because of the flaps 10 that act similar as leaf springs, which are compressed to the inside diameter of the barrel, and the even smaller diameter of a choke at the end of the barrel. The diameter of 5 is always slightly oversized compared to the largest possible barrel diameter of the chosen caliber to ensure high precision in every possible smooth bore barrel of the certain caliber. The design can be adapted for different smooth bore shotgun calibers such as 16 gauge, 20 gauge and so on.

The dimensions of flaps 10, and the cutouts 11 between them, can be varied in number, depth and thickness to achieve very different characteristics and are also viable to adjust the friction between the inner barrel surface and the surface 5, which has influence on the velocity and gas pressure as well. The rear thickness of the flaps can be varied with the bore size 12 and changes of the outer diameter 13. For more powerful loads and smaller calibers such as 16 or 20 gauge, the bore 12 may be reduced even further to achieve proper compression of the projectile. Another advantage is achieved by making the size of the cutouts 11 larger than conventional products. This allows the subject technology to achieve improved compression/expansion characteristics. Another advantage is achieved because cutouts 11 can be created with standard sawblades, whereas current designs that have to be EDM wire cut. The additional part 3 is usually made from plastic, but could also be made from small metal tubing. Part 3 provides additional support for the flaps 6 against compression to the inside.

When the projectile (aka slug) is fired, the surface 5 deforms as much as necessary and ensures greatly improved guidance inside the barrel. Compared to existing designs, the whole length of the projectile with the surfaces 5, 7, 8, and 9 is used for guidance of the projectile and causes high precision and stability of the flying path. The surfaces 7, 8 and 9 with their oversized diameter also act as gas seal in the barrel, leaving no gap between the barrel surface and the plastic because of their oversized diameters. When entering the barrel or the choke, the oversized diameter 7 slightly compresses the flaps 10, of metal part 1 making it somewhat conical and more narrow in the front, ensuring the firm connection of part 1 and 2 without the use of adhesive.

As soon as the whole projectile, consisting of 1, 2 and optionally 3, hits a soft target, the first angled surfaces 14 (in one aspect, angled at 45 degrees, but may also be angled at other degrees,) push the flaps 10 to the outside (i.e. radially outward with respect to bore 12). The immediate expansion of the projectile and the bending of the flaps may separate part 2 from the projectile, leaving the metal first portion to penetrate the target while the plastic second portion does not. The first metal portion, having impacted and penetrated the target, has an appearance as shown in FIG. 4, which shows the flaps 10 having expanded upon impact.

By adjusting the material, heat treatment, thickness of the flaps 10, and length and width of the cutouts 11, a deformation without any parts breaking off the projectile can be achieved, resulting in a deformation according to FIG. 4 without any weight loss of the metal projectile 1. A loss of the flaps resulting in an increased number of holes in target can be achieved, be shortening the cutouts 11 and increasing the hardness of the metal of part 1 trough heat treatment or a change to harder alloys.

On hard targets such as wood or sheet metal, the expansion of the projectile is avoided, because of the hard materials resistance against the expansion on surface 5, making the projectile viable for the reliable penetration of hard objects such as wooden doors or car doors. So targets behind cover can be reliably engaged.

Hard targets, behind soft targets like a 10" block of 10% FBI ballistic gelatine, can hardly be penetrated because of the reliable expansion of the projectile, which is an important advantage of the subject technology. While the energy transfer in soft targets is significant, and hard cover can still be penetrated when hit directly, the reduction of danger behind soft targets is reduced in an unmatched way.

The second portion 2 being made from a material that is relatively lighter than first portion 1, ensures that the center of gravity is in the front, which is also improved by the cavity 15 that can vary in size and shape. It should be understood that, although generally referred to as "plastic part 2", etc herein, other materials could be used so long as the weight thereof relative to first portion 1 allows the center of gravity to be forward oriented. The lighter rear material distributes more weight to front, causing an increased consistency of the flying path. Different types of plastics with a certain amount of elasticity, such as TPU A95, PE etc. may be used.

The cavity 15 causes a reduction of recoil because of a slight elastic compression of the side walls 16 when the projectile is starting to move after pressure building up in the chamber. There is also the possibility of adding different existing recoil reducing designs with holes from one side to side another or similar for even greater recoil reduction.

In some aspects, cavity 17 at the rear of the projectile is added, so the gas pressure of the cartridge is pushing the rear gas seal 9 firmly against the surface of the barrel, sealing the gap between the barrel and the slug for a decreased loss of gas pressure and increased velocity of the projectile. Another advantage of the cavity 17 is the improved weight distribution to the front resulting in improved stability of the flight path. The depth of the cavity as well as the length of the gas seal 9 can be varied because the gas seal 9 can easier be compressed to the barrel inner diameter. The powder of the cartridge may be even located in the cavity to greatly decrease the length of the cartridge, making it viable for shorter chambers.

In one aspect, the length of the current assembled projectile (first and second portions combined) is 37 mm, the outer diameter 5 is about 18.60 mm. The barrel diameters depend from the manufacturer. For instance, a US SAAMI spec standard bore for a 12 GAUGE 2¾ smooth bore barrel is 0.725"+0.02", which is 18.415 to 18.923 mm, but most modem barrels have a diameter of about 18.5 mm, so the projectile is slightly oversized in relation to the barrel. A choke at the end of the barrel may reduce the barrel diameter. A choke of 17.9 mm was successfully tested with the outer diameter 5 about 18.60 mm.

In one aspect, outer diameter 5 of first portion 1 (flaps 10), first gas seal surface 7 of second portion 2, and second gas seal surface 8 of second portion 2 each have about 18.6 mm o.d., and third gas seal surface 9 of second portion 2 has a somewhat larger o.d. (about 18.8 to 18.9 mm) because second cavity 17 of second portion 2 results in a greater deformation.

In one aspect, cutouts 11 of first portion 1 are 0.7 mm. The machined parts are placed in a tumbler to deburr, followed by 1 hour 500° C. annealing, followed by placing the parts in a supersonic cleaner with citric acid. It is important to deburr before annealing. Reversing this process resulted in greater deformation. In one aspect, cutouts 11 of first portion 1 are 0.95 mm. The larger cutout size results in greater flexibility of flaps 10, and this can be also adjusted with third portion 3, as well as the size of outer diameter 13 relative to bore 12. In one aspect, a projectile weight of 32.55 g, travelling at 416 m/s velocity (1364.83 fps), has energy of around 2.800 Joules.

The invention is in no way limited to the specifics of any particular embodiments and examples disclosed herein. For example, the terms "aspect," "example," "preferably," "alternatively," and the like denote features that may be preferable but not essential to include in some embodiments of the invention. In addition, details illustrated or disclosed with respect to any one aspect of the invention may be used with other aspects of the invention. Additional elements and/or steps may be added to various aspects of the invention and/or some disclosed elements and/or steps may be subtracted from various aspects of the invention without departing from the scope of the invention. Singular elements/steps imply plural elements/steps and vice versa. Some steps may be performed serially, in parallel, in a pipelined manner, or in different orders than disclosed herein. Many other variations are possible which remain within the content, scope, and spirit of the invention, and these variations would become clear to those skilled in the art after perusal of this application.

What is claimed is:

1. A shotgun projectile comprising:

a first portion being made from metal and having front and rear portions;

a second portion being made from plastic and having front and rear portions, the front portion of the second portion being adapted to receive the rear portion of the first portion therein such that a shoulder of the first portion abuts the front portion of the second portion;

the first portion having, an interior cavity;

a plurality of flaps, each being circumferentially arranged around the interior cavity, each of the plurality of flaps being spaced apart, and terminating at the rear portion of the first portion;

the plurality of flaps forming an outer diameter of the front portion;

wherein each of the plurality of flaps has an edge formed from first and second angled surfaces;

further wherein the first angled surface of each of the plurality of flaps is angled upward and radially outwardly, whereby each said flap is urged outwardly upon impact;

the second portion having a plurality of gas seal surfaces;

the outer diameter of the first portion and the plurality of gas seal surfaces being adapted to be larger than the inner diameter of a gun barrel through which the first and second portions are discharged.

* * * * *